United States Patent [19]

Nathe et al.

[11] 4,151,850

[45] May 1, 1979

[54] HAIR WAVING APPLIANCE

[76] Inventors: Marcus A. Nathe, P.O. Box 854, Kailua, Hi. 96734; James R. Hannah, 200 Gerhart Ave., Los Angeles, Calif. 90022

[21] Appl. No.: 723,940

[22] Filed: Sep. 17, 1976

[51] Int. Cl.[2] ..... A45D 2/24

[52] U.S. Cl. ..... 132/37 R

[58] Field of Search ..... 132/31, 32 A, 32 R, 132/34, 37, 31 R, 132; 128/DIG. 14; 219/225, 255, 525, 538-539, 282

[56] References Cited

U.S. PATENT DOCUMENTS

| | | | |
|---|---|---|---|
| 1,449,288 | 3/1923 | Killen | 219/225 |
| 1,488,621 | 4/1924 | Simmons | 132/32 A |
| 1,673,071 | 6/1928 | Heisler | 132/132 |
| 1,865,655 | 7/1932 | Walsh | 132/32 R |
| 1,898,467 | 2/1933 | Rochat | 219/225 X |
| 2,400,696 | 5/1946 | Jones | 132/31 R |
| 3,102,941 | 9/1963 | Pope | 132/32 R |
| 3,353,531 | 11/1967 | Armao | 128/DIG. 14 |

*Primary Examiner*—G. E. McNeill

[57] ABSTRACT

A hair waving appliance has in one arm a pair of spaced electrically heated prongs extending from a handle and in another arm a third electrically heated prong with two troughs axially connected on opposite sides thereof extending from another handle. The arms are pivotably connected in a scissor-like manner and spring biased so that in squeezing the handles together the pair of prongs rest in the troughs and straddle the third prong.

7 Claims, 4 Drawing Figures

HAIR WAVING APPLIANCE

BACKGROUND OF THE INVENTION

This invention pertains to hair waving appliances and more particularly to heat hair wavers of the jaw type.

Heated hair curlers are well known in the art. The most common type as exemplified by U.S. Pat. No. 1,691,115 is a scissor-type device having an electrically heated prong which can be accommodated by a jaw having a U-shaped cross-section. Such curlers were popular during the 1920's and 1930's when women's hair styles were directed to tight uniform curls and waves. For fuller curls it was necessary to turn and twist the curler which could result in weakening or breaking the hair. Today the trend is to a more natural look with softer waves. Softer waves can be obtained by using a two pronged hair curler with an electrically heated W-shaped trough such as shown in U.S. Pat. No. 1,488,621. Such a hair waver while producing waves requires a certain amount of expertise and practice. In addition, the waves cannot get as close to the scalp as desired and the user runs the risk of burning or otherwise damaging the hair from overheat. Furthermore, only one side of the hair in the curler is heated resulting in weak shortlasting waves.

SUMMARY OF THE INVENTION

The invention contemplates a hair waving appliance which has extending from one end of an arm a pair of spaced and parallel electrically heatable prongs while from the other end of the arm extends a handle. Another arm carries from one end a third electrically heatable prong to which are fixed on opposite sides thereof through members of thermally conductive material, and from the other end a handle. The bases are pivotably connected together in a scissor-like manner so that when the handles are squeezed together the pair of prongs seat in the respective trough members and straddle the third prong.

It should be noted that any hair placed in the hair waving appliance of the invention is heated on both sides. Therefore, stronger and longer lasting waves are produced with more pronounced ridges and valleys and having an overall firmness. In addition, it can be used to relax tight curly hair.

According to a feature of the invention the prongs are tapered enabling the operator to work the tool into tighter areas of the scalp such as the ear region. In addition, the tapering will result in an overall difference in appearance of the wave pattern which will flow from a tighter to a looser wave as the valley gradually enlarges giving a non-uniform more natural appearance.

Another feature is the provision of a thermostat control to regulate the temperature according to the condition of the hair or synthetic fibers when used with wigs.

Another feature of the invention is the provision of means for biasing the waving appliance to the open position. Thus a much safer appliance is obtained because a positive squeezing action by the operator is required to clamp onto the hair. Upon release of the squeeze the appliance opens automatically.

BRIEF DESCRIPTION OF THE DRAWING

Other objects, the features and advantages of the invention will be apparent from the following detailed description when read with the accompanying drawing which shows by way of explanation and not limitation a hair waving appliance in accordance with the invention.

In the drawing:

In FIGS. 1 and 2 the hair waving appliance 10 is shown having a first arm 12 and a second arm 14. The first arm 12 has a pair of prongs 16 and 18 connected to a base 20 from which extends a hollow handle 22. Within each of the prongs 16 and 18 there is a heating element 24, 26, respectively. The second arm 14 has a prong 28 similar to the pair of prongs 16 and 18 with an internal heating element 34. Fixed to each side of prong 28 and integral therewith are axially extending troughs 30 and 32. A yoke member 36 connects troughs 30 and 32 (and also prong 28) to a handle 38.

Figure 3:
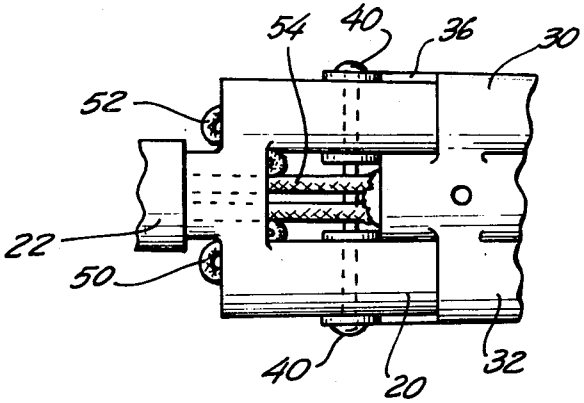
FIG. 3 shows details of the wiring to the heating elements.

The arms 12 and 14 are pivotably connected in a scissor-like manner by means of pin 40 (see FIG. 3) passing through base 20 and yoke member 36.

Figure 4:
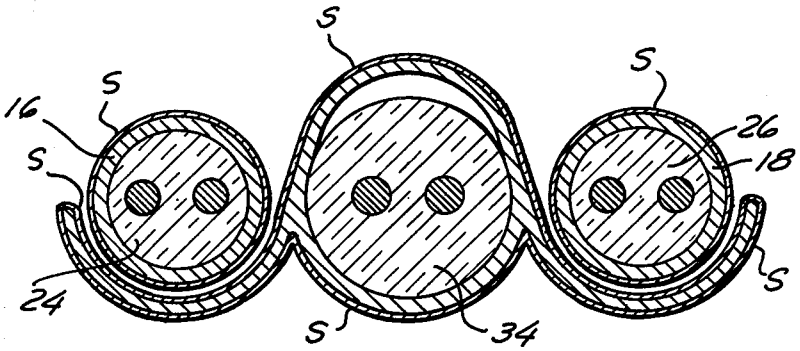
FIG. 4 is a cross-section taken along the line 4—4 of FIG. 2.
Figure 1:
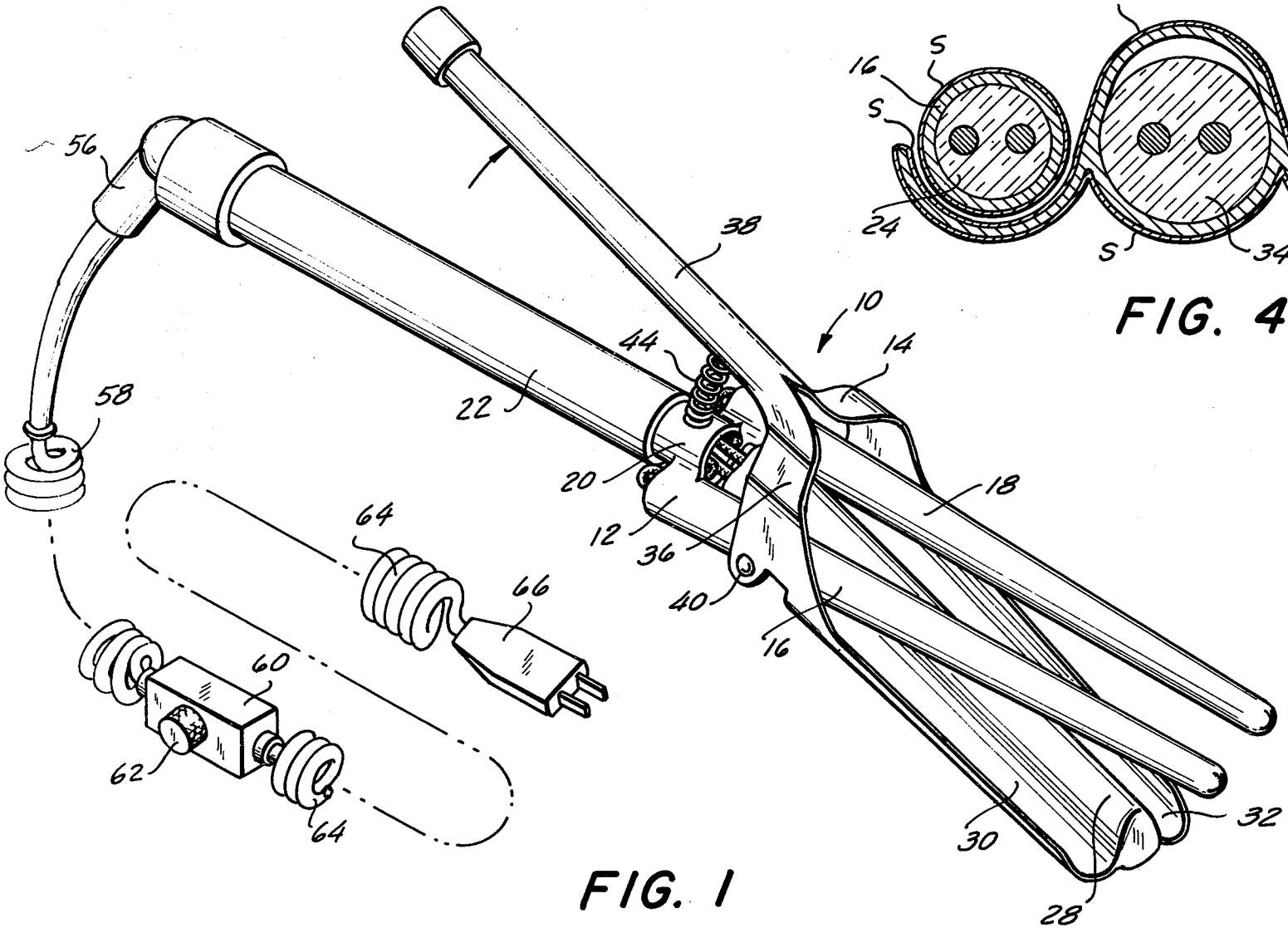
FIG. 1 is a perspective view of the waving appliance in accordance with the invention in the open position.

As a safety feature as well as simplifying the operation of the appliance, there is provided a spring 44 connected between base 20 of arm 12 and handle 38 of arm 14 to bias the jaws of the appliance to the open position as shown in FIG. 1. The location of the spring is not critical and could just as well be wrapped around pin 40 and having respective ends anchored to yoke 36 and base 20.

Although the prongs 16 and 18 can be of uniform cross-section, it has been found to enhance the versatility of the appliance 10 to taper them. In particular it is seen that the diameter of these prongs decreases with the distance from base 20. Similarly the troughs 30 and 32 are formed to conformingly accommodate the tapered prongs.

The surfaces of all three prongs and the troughs are covered with a special material depending on the type of operator using the appliance. If the operator is a professional hair stylist then the surface S is covered with a non-oxidizing heat conducting material and preferably chromium because fast heat transfer is important. If the operator is a home user then the surface S is covered with a non-stick material such as tetraflouroethylene (TEFLON).

The heating elements 24, 26 and 28 are connected to wires 50, 52 and 54 which are joined together within handle 22 which is hollow and passes through swivel connector 56 to helically wound line cord 58 to the output side of controller 60. Controller 60 is a rheostat having a current flow control knob 62 to regulate the flow of current to the heating elements and consequently the operating temperatures of the appliance. The input side of controller 60 is connected via helically wound line cord 64 to male plug 66.

Figure 2:
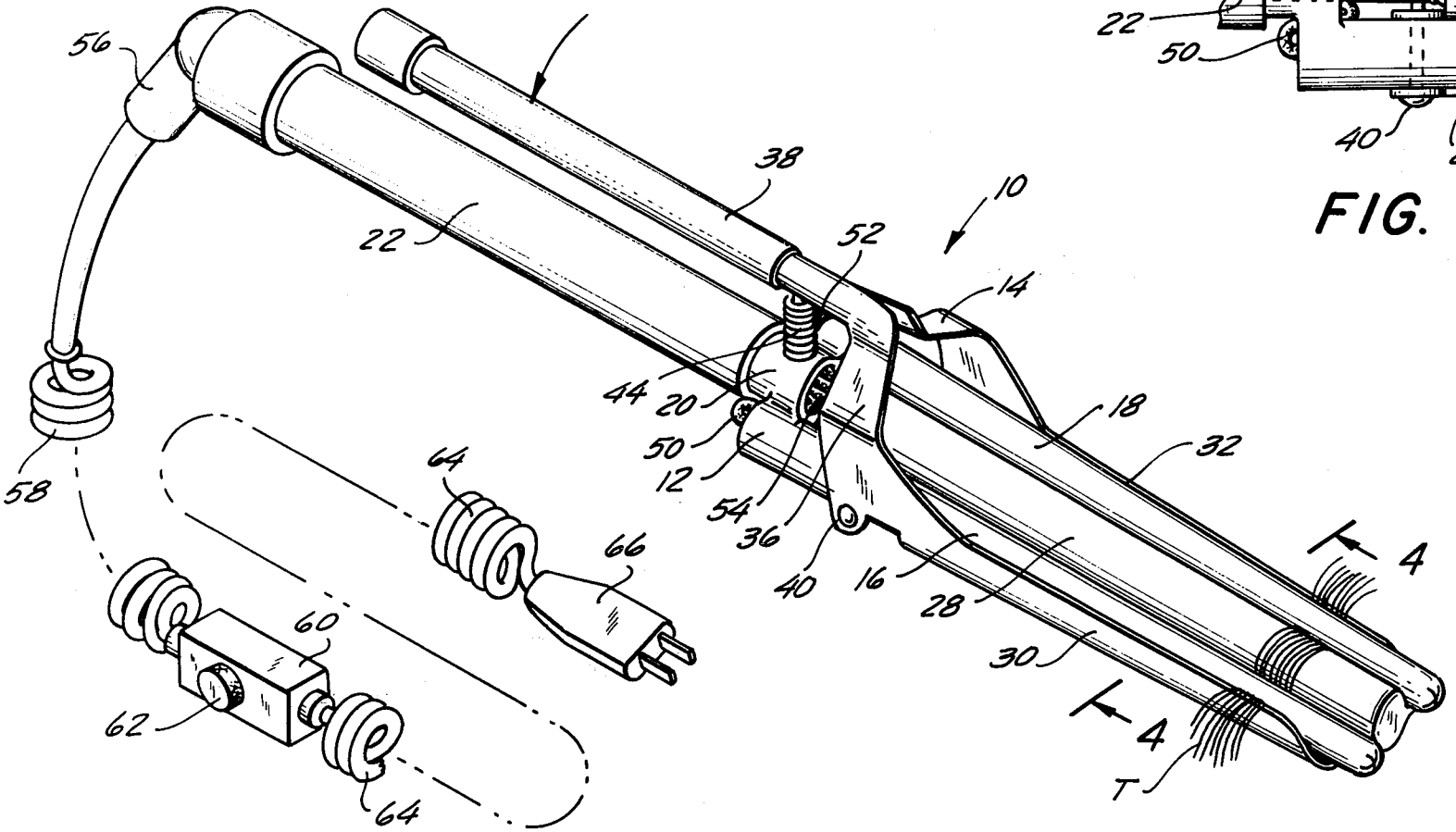
FIG. 2 is a perspective view of the waving appliance when waving a tress of hair.

In operation, after selecting the desired operating temperature by means of knob 62, the user relaxes gripping pressure on the handles 22 and 38 so that the appliance is in the position as shown in FIG. 1 and places the tresses close to the scalp between the open jaws. The user then squeezes the handles together as shown in FIG. 2 and the tresses T are sandwiched between the prongs and troughs. After a suitable time the user releases the pressure and the jaws open automatically by virtue of spring 44. The same same procedure is successively repeated along the tresses to their ends. There is thus obtained a fuller and thicker illusion because of the movement of the closely waved hair.

While only one embodiment of the invention is shown and described in detail there will now be obvious to those skilled in the art many modifications and variations satisfying many or all of the objects of the invention without departing from the spirit thereof as defined by the appended claims.

What is claimed is:

1. A hair waving applicance comprising: one arm having a pair of spaced parallel prongs of heat conducting material, a first handle connected to one end of said pair of prongs, said prongs being of substantially circular cross section and an electrical heating element in each of said prongs; a second arm having a third prong of heat conducting material, an electrical heating element in said third prong, first and second trough members fixed to opposite sides of said third prong and extending axially along its length, said trough members being of a heat conducting material whereby some of the heat generated by the heating element in said third prong flows to said troughs, said first and second trough members being of semi-circular cross-section for conformingly accommodating said pair of prongs in substantially aligned relation with said third prong, whereby a lock of hair can extend in undulating fashion between said pair of prongs and said trough members and over said third prong and said lock of hair receives heat at opposite surfaces by said prongs and trough members along the substantial semi-circular extent thereof, a second handle connected to said third prong and troughs and extending in the same direction of said first handle; and connecting means for pivotably connecting said first and second arms in the region of the connection of the handles to their respective prongs in a scissor-like manner so that on squeezing the handles together said pair of prongs can rest in said troughs and straddle said third prong; and an electrical wire passing through one of said handles, said wire having a first end connected to each of said heating elements and a second end adapted to be connected to a source of electricity.

2. The hair waving appliance of claim 1 wherein said connecting means includes spring means for urging said pair of prongs away from said first and second trough members.

3. The hair waving appliance of claim 1 further comprising means for controlling the amount of electricity fed to the electrical heating elements in said prongs and therefore the temperature of said prongs and trough members.

4. The hair waving appliance of claim 3 wherein said controlling means is a rheostat having an input side and an output side, wire means connecting said output side to said electrical heating elements, a male plug and a helically wound wire interconnecting said male plug and said input side.

5. The hair waving appliance of claim 4 wherein said wire means includes wires, a swivel connector connected to one of said handles, said one handle being hollow, said wires passing through said swivel connector and said one handle to each of said electrical heating elements.

6. The hair waving appliance of claim 1 wherein said prongs and said trough members are covered with a layer of chromium.

7. The hair waving appliance of claim 1 wherein said prongs and said trough members are covered with a layer of tetraflouroethylene.

* * * * *